US007765716B2

(12) United States Patent
Kim

(10) Patent No.: US 7,765,716 B2
(45) Date of Patent: Aug. 3, 2010

(54) DRYER HAVING INTAKE DUCT WITH HEATER INTEGRATED THEREIN

(75) Inventor: Chang Hoo Kim, Incheon (KR)

(73) Assignee: Daewoo Electronics Corporation, Seoul (KR)

( * ) Notice: Subject to any disclaimer, the term of this patent is extended or adjusted under 35 U.S.C. 154(b) by 0 days.

(21) Appl. No.: 12/265,016

(22) Filed: Nov. 5, 2008

(65) Prior Publication Data

US 2009/0113743 A1 May 7, 2009

(30) Foreign Application Priority Data

Nov. 5, 2007 (KR) ..... 10-2007-0112009

(51) Int. Cl.
*F26B 11/20* (2006.01)

(52) U.S. Cl. ..... 34/602; 34/610; 134/1; 68/12.08

(58) Field of Classification Search ..... 34/595, 34/602, 603, 604, 606, 610; 134/1; 68/12.08
See application file for complete search history.

(56) References Cited

U.S. PATENT DOCUMENTS 1,830,324 A * 11/1931 La Mont ..... 122/39
2,165,884 A * 7/1939 Chamberlin et al. ..... 8/159
2,225,407 A * 12/1940 Bassett, Jr. ..... 68/12.21
2,262,186 A * 11/1941 Lindberg ..... 34/607
RE22,375 E * 9/1943 Chamberlin et al. ..... 8/159
2,460,422 A * 2/1949 Koppel ..... 34/606
2,467,393 A * 4/1949 Leher ..... 392/401
2,477,820 A * 8/1949 Pokras ..... 34/131
2,503,330 A * 4/1950 Geldhof ..... 432/117
2,521,712 A * 9/1950 Geldhof ..... 34/82
2,547,238 A * 4/1951 Tremblay ..... 34/603
2,574,251 A * 11/1951 Dinley ..... 68/12.08
2,617,203 A * 11/1952 Murray ..... 34/82
2,619,737 A * 12/1952 Geldhof et al. ..... 34/604
2,679,112 A * 5/1954 Thompson ..... 34/562
2,686,978 A * 8/1954 Herbster ..... 34/608
2,694,867 A * 11/1954 Smith ..... 34/605
2,707,837 A * 5/1955 Paulsen et al. ..... 34/607
2,748,496 A * 6/1956 Hellyer ..... 34/603
2,771,836 A * 11/1956 Denehie et al. ..... 99/323.7
2,798,306 A * 7/1957 Reiter ..... 34/609
2,798,307 A * 7/1957 Reiter ..... 34/610
2,807,893 A * 10/1957 Morey ..... 34/597
2,851,793 A * 9/1958 Thompson ..... 34/601
2,873,539 A * 2/1959 Morey ..... 34/597
2,884,710 A * 5/1959 Smith ..... 34/601
2,886,901 A * 5/1959 Whyte et al. ..... 34/601
2,893,135 A * 7/1959 Smith ..... 34/610
2,949,679 A * 8/1960 Maccracken et al. ..... 34/598
2,958,138 A * 11/1960 Ashby ..... 34/601
2,958,139 A * 11/1960 Smith ..... 34/604
2,958,140 A * 11/1960 Smith ..... 34/598

(Continued)

*Primary Examiner*—Stephen M. Gravini
(74) *Attorney, Agent, or Firm*—Occhiuti Rohlicek & Tsao LLP

(57) ABSTRACT

Disclosed herein is a dryer having a heater-integrated intake duct capable of reducing thermal loss and preventing overheating of the dryer. The dryer includes a support panel having a through-hole, an intake duct communicating with the through-hole, a drum into which air flows via the through-hole, a heater disposed inside the intake duct to heat the air flowing into the drum, and an extended part configured to cause the heated air to be supplied into the drum after bypassing the extended part.

8 Claims, 8 Drawing Sheets

U.S. PATENT DOCUMENTS

| | | | | | |
|---|---|---|---|---|---|
| 2,961,776 | A | * | 11/1960 | Hughes | 34/607 |
| 2,975,528 | A | * | 3/1961 | Shewmon | 34/601 |
| 2,985,967 | A | * | 5/1961 | Pataillot et al. | 34/608 |
| 3,000,108 | A | * | 9/1961 | Paul et al. | 34/607 |
| 3,017,758 | A | * | 1/1962 | Haverstock et al. | 68/19 |
| 3,060,593 | A | * | 10/1962 | Flora et al. | 34/601 |
| 3,103,112 | A | * | 9/1963 | Behrens et al. | 68/18 R |
| 3,106,831 | A | * | 10/1963 | Behrens | 68/12.08 |
| 3,110,153 | A | * | 11/1963 | House | 60/207 |
| 3,167,409 | A | * | 1/1965 | Brucken | 34/601 |
| 3,182,869 | A | * | 5/1965 | Richterkessing | 223/73 |
| 3,218,732 | A | * | 11/1965 | Alaback | 34/603 |
| 3,220,120 | A | * | 11/1965 | Ross | 34/601 |
| 3,239,947 | A | * | 3/1966 | Kenreich et al. | 34/597 |
| 3,242,589 | A | * | 3/1966 | Jacobs | 34/595 |
| 3,250,097 | A | * | 5/1966 | Czech | 68/12.09 |
| 3,256,617 | A | * | 6/1966 | Goldberger | 34/661 |
| 3,263,592 | A | * | 8/1966 | Hickey et al. | 99/339 |
| 3,270,531 | A | * | 9/1966 | Czech | 68/18 F |
| 3,273,256 | A | * | 9/1966 | Behrens | 34/546 |
| 3,274,807 | A | * | 9/1966 | Czech | 68/12.09 |
| 3,289,317 | A | * | 12/1966 | Lough et al. | 34/604 |
| 3,302,302 | A | * | 2/1967 | Ferrer | 34/605 |
| 3,331,141 | A | * | 7/1967 | Jacobs et al. | 34/599 |
| 3,344,532 | A | * | 10/1967 | Bigler | 34/600 |
| 3,357,834 | A | * | 12/1967 | Hickey et al. | 426/437 |
| 3,387,385 | A | * | 6/1968 | Mandarino, Jr. et al. | 34/596 |
| 3,398,465 | A | * | 8/1968 | Miller et al. | 34/599 |
| 3,409,997 | A | * | 11/1968 | Krolzick et al. | 34/601 |
| 3,429,056 | A | * | 2/1969 | Metzger | 34/601 |
| 3,555,701 | A | * | 1/1971 | Hubbard | 34/602 |
| 3,570,138 | A | * | 3/1971 | Douglas et al. | 34/601 |
| 3,584,394 | A | * | 6/1971 | Grabek | 34/599 |
| 3,616,545 | A | * | 11/1971 | Jacobs | 34/599 |
| 3,616,547 | A | * | 11/1971 | Schuurink | 34/609 |
| 3,635,193 | A | * | 1/1972 | Stease | 118/63 |
| 3,645,010 | A | * | 2/1972 | Korekawa | 34/599 |
| 3,793,056 | A | * | 2/1974 | Stease | 427/315 |
| 3,805,404 | A | * | 4/1974 | Gould | 34/75 |
| 3,815,258 | A | * | 6/1974 | Beard, Jr. | 34/602 |
| 3,819,319 | A | * | 6/1974 | Schreter | 431/5 |
| 3,840,326 | A | * | 10/1974 | Schreter | 431/114 |
| 3,917,458 | A | * | 11/1975 | Polak | 422/169 |
| 3,937,227 | A | * | 2/1976 | Azumano | 131/302 |
| 3,986,918 | A | * | 10/1976 | Berner | 156/497 |
| 4,033,047 | A | * | 7/1977 | Kawai | 34/82 |
| 4,035,121 | A | * | 7/1977 | Wood | 425/83.1 |
| 4,207,686 | A | * | 6/1980 | Daily | 34/610 |
| 4,467,534 | A | * | 8/1984 | Murase | 34/82 |
| 4,468,867 | A | * | 9/1984 | Iwase | 34/82 |
| 4,476,804 | A | * | 10/1984 | Glatt et al. | 118/19 |
| 4,489,507 | A | * | 12/1984 | Kawai | 34/77 |
| 4,516,335 | A | * | 5/1985 | Aoki et al. | 34/608 |
| 4,550,509 | A | * | 11/1985 | Murase | 34/604 |
| 4,621,438 | A | * | 11/1986 | Lanciaux | 34/77 |
| 4,662,288 | A | * | 5/1987 | Hastings et al. | 109/2 |
| 4,700,495 | A | * | 10/1987 | Drews et al. | 34/603 |
| 4,722,681 | A | * | 2/1988 | Smith | 431/7 |
| 4,765,066 | A | * | 8/1988 | Yoon | 34/261 |
| 4,825,560 | A | * | 5/1989 | Nakamura et al. | 34/609 |
| 4,830,651 | A | * | 5/1989 | Smith | 65/120 |
| 4,899,464 | A | * | 2/1990 | Carr et al. | 34/604 |
| 4,941,333 | A | * | 7/1990 | Blessing | 68/19.2 |
| 4,989,347 | A | * | 2/1991 | Kretchman | 34/607 |
| 5,042,171 | A | * | 8/1991 | Obata et al. | 34/604 |
| 5,107,606 | A | * | 4/1992 | Tsubaki et al. | 34/596 |
| 5,127,169 | A | * | 7/1992 | Ellingson | 34/601 |
| 5,145,056 | A | * | 9/1992 | Smith | 198/814 |
| 5,258,306 | A | * | 11/1993 | Goldfarb | 435/290.2 |
| 5,306,140 | A | * | 4/1994 | Smith | 431/328 |
| 5,385,037 | A | * | 1/1995 | Bae | 68/16 |
| 5,421,103 | A | * | 6/1995 | Wunderlich | 34/599 |
| 5,495,681 | A | * | 3/1996 | Paradis | 34/602 |
| 5,548,908 | A | * | 8/1996 | Torborg et al. | 34/601 |
| 5,555,647 | A | * | 9/1996 | Torborg et al. | 34/601 |
| 5,642,601 | A | * | 7/1997 | Thompson et al. | 53/431 |
| 5,701,684 | A | * | 12/1997 | Johnson | 34/595 |
| 5,709,041 | A | * | 1/1998 | Tarplee | 34/595 |
| 5,768,730 | A | * | 6/1998 | Matsumoto et al. | 8/159 |
| 5,771,604 | A | * | 6/1998 | Wunderlich et al. | 34/603 |
| 6,024,905 | A | * | 2/2000 | Doris | 264/121 |
| 6,098,312 | A | * | 8/2000 | Tuggle | 34/607 |
| 6,280,638 | B1 | * | 8/2001 | Belchev | 210/770 |
| 6,327,994 | B1 | * | 12/2001 | Labrador | 114/382 |
| 6,370,798 | B1 | * | 4/2002 | Gonzalez, Sr. | 34/595 |
| 6,434,857 | B1 | * | 8/2002 | Anderson et al. | 34/595 |
| 6,438,862 | B1 | * | 8/2002 | Soucy | 34/168 |
| 6,544,357 | B1 | * | 4/2003 | Hehmann et al. | 148/420 |
| 6,618,958 | B2 | * | 9/2003 | Myung et al. | 34/602 |
| 6,643,953 | B2 | * | 11/2003 | Song et al. | 34/604 |
| 6,647,643 | B2 | * | 11/2003 | Song et al. | 34/595 |
| 6,678,969 | B1 | * | 1/2004 | Hong | 34/595 |
| 6,684,648 | B2 | * | 2/2004 | Faqih | 62/93 |
| 6,688,018 | B2 | * | 2/2004 | Soucy | 34/68 |
| 6,698,107 | B2 | * | 3/2004 | Song et al. | 34/595 |
| 6,751,888 | B2 | * | 6/2004 | Lueckenbach | 34/595 |
| 6,766,623 | B1 | * | 7/2004 | Kalnay | 52/641 |
| 6,829,845 | B2 | * | 12/2004 | Han et al. | 34/603 |
| 6,874,250 | B2 | * | 4/2005 | Prajescu et al. | 34/606 |
| 6,908,516 | B2 | * | 6/2005 | Hehmann et al. | 148/406 |
| 6,928,752 | B2 | * | 8/2005 | Johnson et al. | 34/595 |
| 6,941,679 | B1 | * | 9/2005 | Harris et al. | 34/596 |
| 6,954,992 | B2 | * | 10/2005 | Hwang | 34/108 |
| 6,968,632 | B2 | * | 11/2005 | Guinibert et al. | 34/602 |
| 7,017,282 | B2 | * | 3/2006 | Pyo et al. | 34/596 |
| 7,020,985 | B2 | * | 4/2006 | Casey et al. | 34/595 |
| 7,032,326 | B2 | * | 4/2006 | Hong | 34/602 |
| 7,036,243 | B2 | * | 5/2006 | Doh et al. | 34/595 |
| 7,062,863 | B2 | * | 6/2006 | Chung | 34/596 |
| 7,065,904 | B2 | * | 6/2006 | Lee et al. | 34/601 |
| 7,065,905 | B2 | * | 6/2006 | Guinibert et al. | 34/603 |
| 7,069,669 | B2 | * | 7/2006 | Park et al. | 34/603 |
| 7,093,377 | B2 | * | 8/2006 | Doh et al. | 34/596 |
| 7,093,378 | B2 | * | 8/2006 | Jeong et al. | 34/601 |
| 7,121,018 | B2 | * | 10/2006 | Lee | 34/595 |
| 7,140,123 | B2 | * | 11/2006 | Lee | 34/601 |
| 7,152,614 | B2 | * | 12/2006 | Kalnay | 135/128 |
| 7,178,264 | B2 | * | 2/2007 | Kim | 34/596 |
| 7,194,824 | B2 | * | 3/2007 | Wang | 34/602 |
| 7,204,039 | B2 | * | 4/2007 | Cho et al. | 34/596 |
| 7,220,365 | B2 | * | 5/2007 | Qu et al. | 252/70 |
| 7,225,562 | B2 | * | 6/2007 | Guinibert et al. | 34/601 |
| 7,228,647 | B2 | * | 6/2007 | Hong | 34/596 |
| 7,251,905 | B2 | * | 8/2007 | Doh et al. | 34/603 |
| 7,322,127 | B2 | * | 1/2008 | Hwang | 34/603 |
| 7,325,332 | B2 | * | 2/2008 | Chung et al. | 34/602 |
| 7,325,333 | B2 | * | 2/2008 | Tadano et al. | 34/604 |
| 7,340,847 | B2 | * | 3/2008 | Kim | 34/601 |
| 7,340,849 | B2 | * | 3/2008 | Kim | 34/602 |
| 7,347,009 | B2 | * | 3/2008 | Ahn et al. | 34/607 |
| 7,406,780 | B2 | * | 8/2008 | Doh et al. | 34/606 |
| 7,434,334 | B2 | * | 10/2008 | Hwang et al. | 34/606 |
| 7,467,483 | B2 | * | 12/2008 | Guinibert et al. | 34/601 |
| 7,506,458 | B2 | * | 3/2009 | Lee et al. | 34/601 |
| 7,523,564 | B2 | * | 4/2009 | Doh | 34/601 |
| 7,526,879 | B2 | * | 5/2009 | Bae et al. | 34/596 |
| 7,543,396 | B2 | * | 6/2009 | Nishino et al. | 34/606 |
| 7,552,545 | B2 | * | 6/2009 | Crawford et al. | 34/600 |
| 7,559,156 | B2 | * | 7/2009 | Renzo | 34/595 |
| 7,562,467 | B2 | * | 7/2009 | Doh | 34/601 |
| 2002/0046569 | A1 | * | 4/2002 | Faqih | 62/188 |
| 2003/0000104 | A1 | * | 1/2003 | Song et al. | 34/595 |
| 2003/0000105 | A1 | * | 1/2003 | Song et al. | 34/595 |
| 2003/0000106 | A1 | * | 1/2003 | Anderson et al. | 34/598 |

2003/0037460 A1* 2/2003 Song et al. ..... 34/595
2003/0056393 A1* 3/2003 Lee et al. ..... 34/595
2003/0066638 A1* 4/2003 Qu et al. ..... 165/186
2003/0079363 A1* 5/2003 Soucy ..... 34/60
2003/0136022 A1* 7/2003 Myung et al. ..... 34/595
2003/0183306 A1* 10/2003 Hehmann et al. ..... 148/404
2004/0010936 A1* 1/2004 Han ..... 34/595
2004/0025366 A1* 2/2004 Soucy ..... 34/230
2004/0060196 A1* 4/2004 Lueckenbach ..... 34/595
2004/0060197 A1* 4/2004 Jeong et al. ..... 34/595
2004/0098878 A1* 5/2004 Park et al. ..... 34/595
2004/0103556 A1* 6/2004 Bang ..... 34/595
2004/0118013 A1* 6/2004 Kohlman et al. ..... 34/595
2004/0123486 A1* 7/2004 Hameed et al. ..... 34/595
2004/0134092 A1* 7/2004 Hong et al. ..... 34/595
2004/0134093 A1* 7/2004 Han ..... 34/595
2004/0163276 A1* 8/2004 Han et al. ..... 34/603
2004/0168343 A1* 9/2004 Park ..... 34/606
2004/0168344 A1* 9/2004 Park ..... 34/606
2004/0194339 A1* 10/2004 Johnson et al. ..... 34/595
2004/0200093 A1* 10/2004 Wunderlin et al. ..... 34/606
2004/0216327 A1* 11/2004 Chung ..... 34/607
2004/0237338 A1* 12/2004 Rump et al. ..... 34/607
2004/0261288 A1* 12/2004 Beyerle et al. ..... 34/602
2005/0016015 A1* 1/2005 Prajescu et al. ..... 34/601
2005/0044744 A1* 3/2005 Tadano et al. ..... 34/596
2005/0050764 A1* 3/2005 Jeong et al. ..... 34/601
2005/0050765 A1* 3/2005 Park et al. ..... 34/603
2005/0060951 A1* 3/2005 Kalnay ..... 52/641
2005/0076535 A1* 4/2005 Guinibert et al. ..... 34/601
2005/0086832 A1* 4/2005 Declos ..... 34/604
2005/0097772 A1* 5/2005 Lee ..... 34/601
2005/0102853 A1* 5/2005 Wang ..... 34/602
2005/0108893 A1* 5/2005 Hwang et al. ..... 34/603
2005/0115104 A1* 6/2005 Guinibert et al. ..... 34/601
2005/0120585 A1* 6/2005 Lee et al. ..... 34/602
2005/0126035 A1* 6/2005 Lee et al. ..... 34/602
2005/0132601 A1* 6/2005 Doh ..... 34/601
2005/0132602 A1* 6/2005 Jeong et al. ..... 34/602
2005/0132604 A1* 6/2005 Hong et al. ..... 34/603
2005/0138836 A1* 6/2005 Hwang et al. ..... 34/603
2005/0155250 A1* 7/2005 Chung et al. ..... 34/602
2005/0155251 A1* 7/2005 Lee ..... 34/604
2005/0166421 A1* 8/2005 Doh et al. ..... 34/603
2005/0217139 A1* 10/2005 Hong ..... 34/604
2005/0223592 A1* 10/2005 Hong ..... 34/601
2005/0235519 A1* 10/2005 Chung ..... 34/607
2005/0252029 A1* 11/2005 Kim ..... 34/596
2005/0252030 A1* 11/2005 Park et al. ..... 34/601
2005/0252031 A1* 11/2005 Park et al. ..... 34/601
2005/0252032 A1* 11/2005 Park et al. ..... 34/604
2005/0268483 A1* 12/2005 Park et al. ..... 34/603
2006/0041448 A1* 2/2006 Patterson et al. ..... 705/1
2006/0086001 A1* 4/2006 Jeong et al. ..... 34/606
2006/0101666 A1* 5/2006 Cho et al. ..... 34/596
2006/0112590 A1* 6/2006 Kim ..... 34/603
2006/0117596 A1* 6/2006 Kim et al. ..... 34/607
2006/0196077 A1* 9/2006 Choi ..... 34/602
2006/0218817 A1* 10/2006 Lee ..... 34/604
2006/0236560 A1* 10/2006 Doh et al. ..... 34/596
2006/0254082 A1* 11/2006 Kim ..... 34/595
2006/0260150 A1* 11/2006 Doh ..... 34/601
2006/0265899 A1* 11/2006 Renzo ..... 34/603
2006/0288608 A1* 12/2006 Carow et al. ..... 34/604
2007/0006485 A1* 1/2007 Kim ..... 34/603
2007/0151119 A1* 7/2007 Heyder et al. ..... 34/601
2007/0186440 A1* 8/2007 Guinibert et al. ..... 34/603
2007/0199207 A1* 8/2007 Oh et al. ..... 34/602
2007/0209228 A1* 9/2007 Meerpohl et al. ..... 34/595
2007/0220776 A1* 9/2007 Guinibert et al. ..... 34/603
2007/0256322 A1* 11/2007 Kim et al. ..... 34/603
2008/0022551 A1* 1/2008 Banta et al. ..... 34/602
2008/0022552 A1* 1/2008 Forget ..... 34/602
2008/0053166 A1* 3/2008 Lim ..... 68/5
2008/0060218 A1* 3/2008 Doh ..... 34/601
2008/0141558 A1* 6/2008 Bae et al. ..... 34/595
2008/0178819 A1* 7/2008 Sia et al. ..... 119/300
2008/0196268 A1* 8/2008 Jung et al. ..... 34/603
2008/0254237 A1* 10/2008 Omatsu et al. ..... 428/1.31
2009/0056741 A1* 3/2009 Iida et al. ..... 134/1
2009/0064534 A1* 3/2009 LeClerc ..... 34/603
2009/0071033 A1* 3/2009 Ahn et al. ..... 34/595
2009/0083991 A1* 4/2009 Prajescu ..... 34/601
2009/0083992 A1* 4/2009 Prajescu et al. ..... 34/601
2009/0113743 A1* 5/2009 Kim ..... 34/132
2009/0134338 A1* 5/2009 Eguchi et al. ..... 250/396 R
2009/0158616 A1* 6/2009 Ricklefs et al. ..... 34/601
2009/0158617 A1* 6/2009 Ricklefs et al. ..... 34/603

* cited by examiner

DRYER HAVING INTAKE DUCT WITH HEATER INTEGRATED THEREIN

CROSS-REFERENCE TO RELATED APPLICATIONS

This application claims priority to Korean Application No. 10-2007-0112009 filed on Nov. 5, 2007, the content of which is hereby incorporated by reference in its entirety.

BACKGROUND OF THE INVENTION

1. Field of the Invention

The present invention relates to a dryer, and more particularly to a dryer that has a heater-integrated intake duct capable of reducing thermal loss and preventing overheating of the dryer.

2. Description of the Related Art

FIG. 1 is a schematic sectional view showing a flow passage of a conventional dryer, and FIG. 2 is a partially cut-away perspective view of the conventional dryer.

Referring to FIGS. 1 and 2, the conventional dryer includes a case 2 constituting an outer appearance of the dryer, a drum 12 rotatably disposed inside the case 2, a heater 18 disposed at a lower side of the case 2 to heat air introduced into the case 2, an intake duct 20 guiding air heated by the heater 18 to the rear of the drum 12, an exhaust mechanism 22 for discharging air to the outside of the case 2, a ventilation fan (not shown) provided to the exhaust mechanism 22, and a motor (not shown) and a fan belt 40 disposed at the lower side of the case 2 to drive the drum 12 and the ventilation fan. Further, the drum 12 has lifters 11 coupled to an inner surface thereof to lift and drop laundry during a drying operation.

The exhaust mechanism 22 includes a lint duct 25 defining a flow passage of air discharged from the drum 12 and having a filter 24 to separate foreign matter from air flowing through the lint duct 25, a fan housing 26 communicating with the lint duct 25 and surrounding the ventilation fan 30, and an exhaust duct 27 having one end communicating with the ventilation fan and the other end disposed outside the case 2.

Operation of the conventional dryer will be described below.

First, when the dryer is operated with laundry received in the drum 12, the drum 12 and the ventilation fan are rotated, and the heater 18 is operated.

While the drum 12 is rotated, the laundry received in the drum 12 is lifted by the lifters 11 and then falls down inside the drum 12. Further, while being sucked into the drum 12 through the heater 18 by a ventilation force caused by rotation of the ventilation fan, external air is changed into high-temperature low-humidity air by the heater 18 and flows into the drum 12 through the intake duct 20.

Inside the drum 12, high-temperature low-humidity air having flown into the drum 12 dries the laundry, changes into low-temperature high-humidity air, and is finally discharged to the outside of the dryer through the exhaust duct 27.

In the conventional dryer, however, since the heater is accommodated in a separate tube extending from the intake duct and located inside the cabinet, making it difficult to reduce the distance between the heater and the drum to a predetermined distance or less, the air heated by the heater experiences thermal loss while flowing into the drum.

Further, since the drive motor and the heater, both of which are likely to overheat, are all disposed at the lower side of the cabinet in the conventional dryer, the interior of the dryer can be overheated to cause malfunction or damage of the dryer.

Therefore, there is a need for an improved dryer that overcomes such problems of the conventional dryer.

SUMMARY OF THE INVENTION

The present invention is conceived to solve the problems of the conventional techniques, and an aspect of the present invention is to provide a dryer that has a heater-integrated intake duct capable of reducing thermal loss and preventing overheating of the dryer.

In accordance with the present invention, the above and other aspects can be accomplished by the provision of a dryer having a heater-integrated intake duct, including: a support panel having a through-hole; an intake duct communicating with the through-hole; a drum into which air flows via the through-hole; a heater disposed inside the intake duct to heat the air flowing into the drum; and an extended part configured to cause the heated air to be supplied into the drum after surmounting the extended part.

The intake duct may include a supply hole communicating with the through-hole, a suction hole into which the air is introduced, and a bent part formed by bending an end of the intake duct, which is formed with the supply hole, toward the through-hole.

The supply hole may include first holes formed in a region corresponding to a region extending upward from a location where the extended part terminates, and second holes formed in a region corresponding to the extended part.

The number of second holes may be less than the number of first holes.

The second holes may have larger sizes than those of the first holes.

The extended part may include a partition provided to the bent part.

The extended part may extend from the bent part in a flow direction of air.

One side of the intake duct may be disposed outside the cabinet. The one side of the intake duct may be disposed on a lateral side of the cabinet.

The heater may be disposed on a lateral side of the cabinet. The dryer may further include a drive motor disposed at a lower side of the cabinet.

BRIEF DESCRIPTION OF THE DRAWINGS

The above and other aspects, features and advantages of the present invention will become apparent from the following description of exemplary embodiments given in conjunction with the accompanying drawings, in which.

DETAILED DESCRIPTION OF THE INVENTION

Exemplary embodiments of a dryer having a heater-integrated intake duct according to the present invention will be described in detail with reference to the accompanying drawings. Herein, the dryer having the heater-integrated intake duct will be described as an example for convenience of description. The drawings may be exaggerated in thickness of lines or scale of components for the purpose of descriptive convenience and clarity only. Furthermore, terms used herein should be defined in consideration of functions of components of the present invention and thus can be changed according to the custom or intention of users or operators. Therefore, definition of such terms should be determined according to overall disclosures set forth herein.

Figure 1:
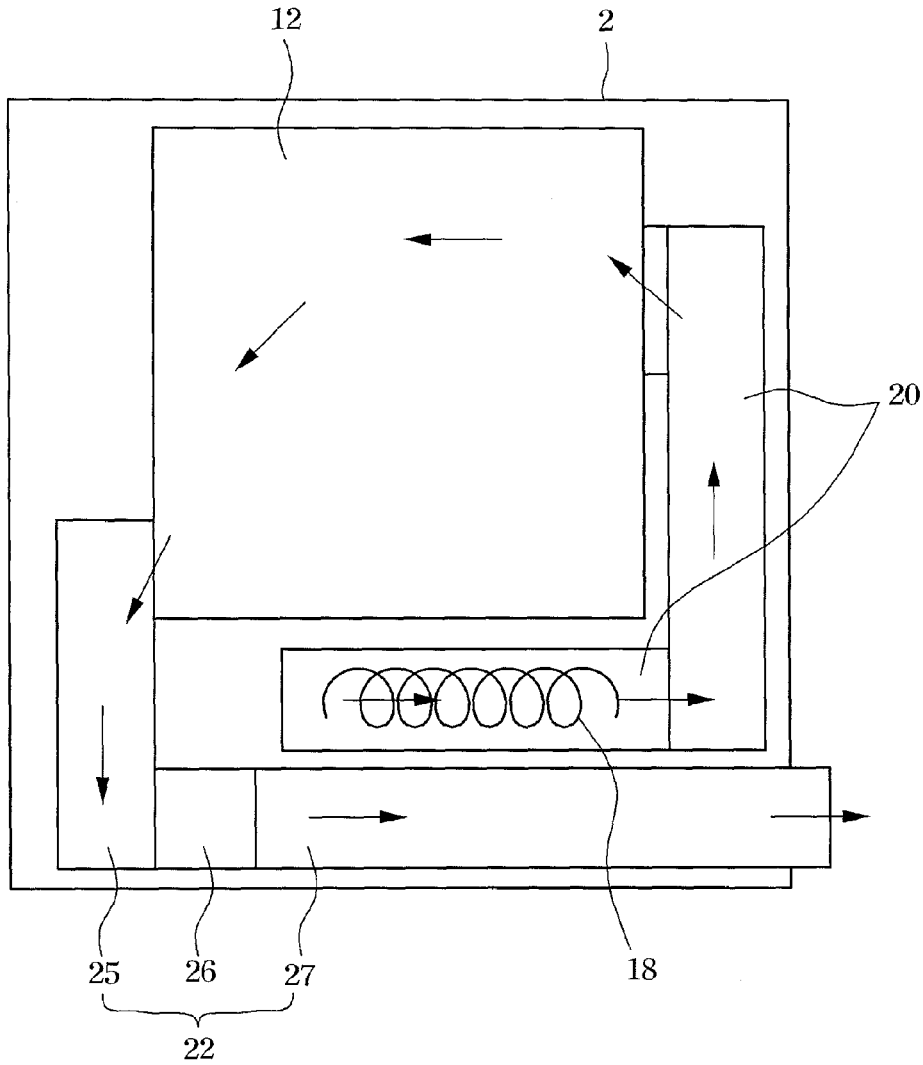
FIG. 1 PRIOR ART
FIG. 1 is a schematic sectional view showing a flow passage of a conventional dryer.
Figure 2:
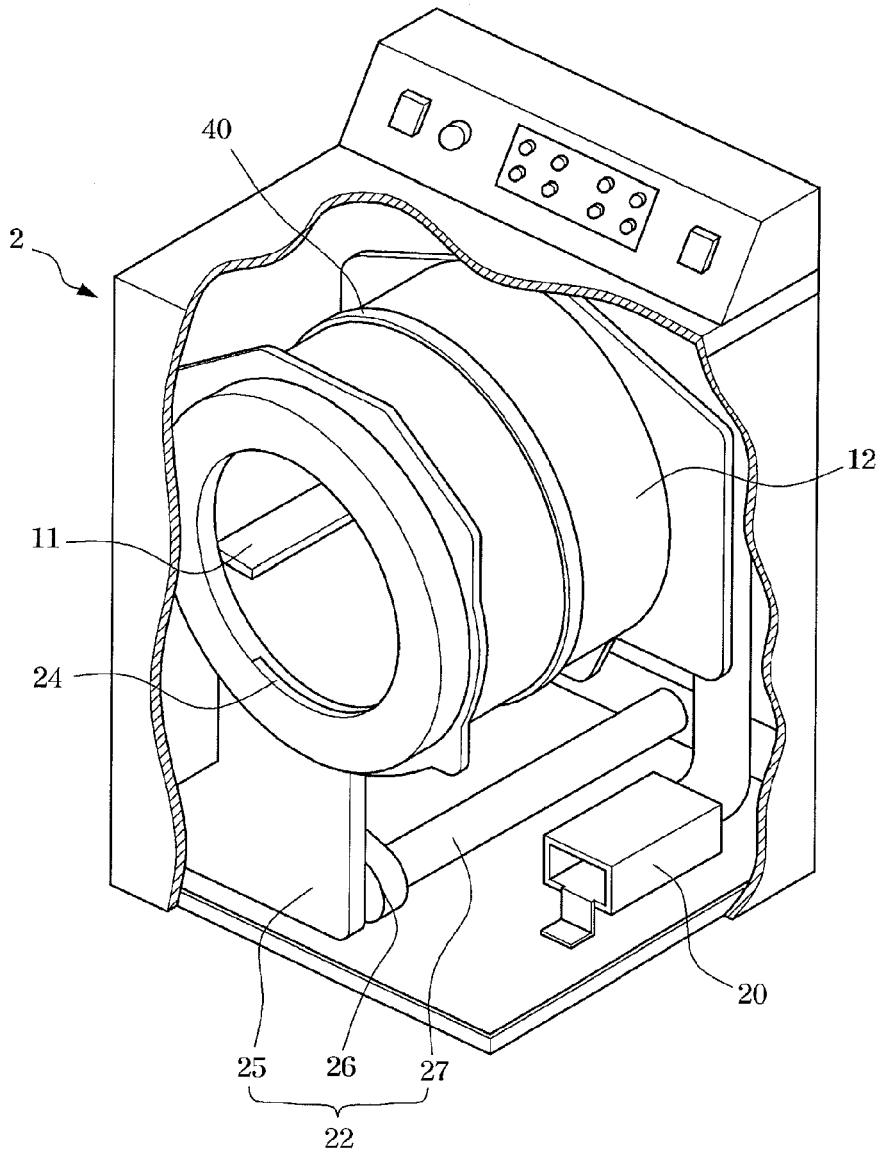
FIG. 2 PRIOR ART
FIG. 2 is a partially cut-away perspective view of the conventional dryer.
Figure 3:
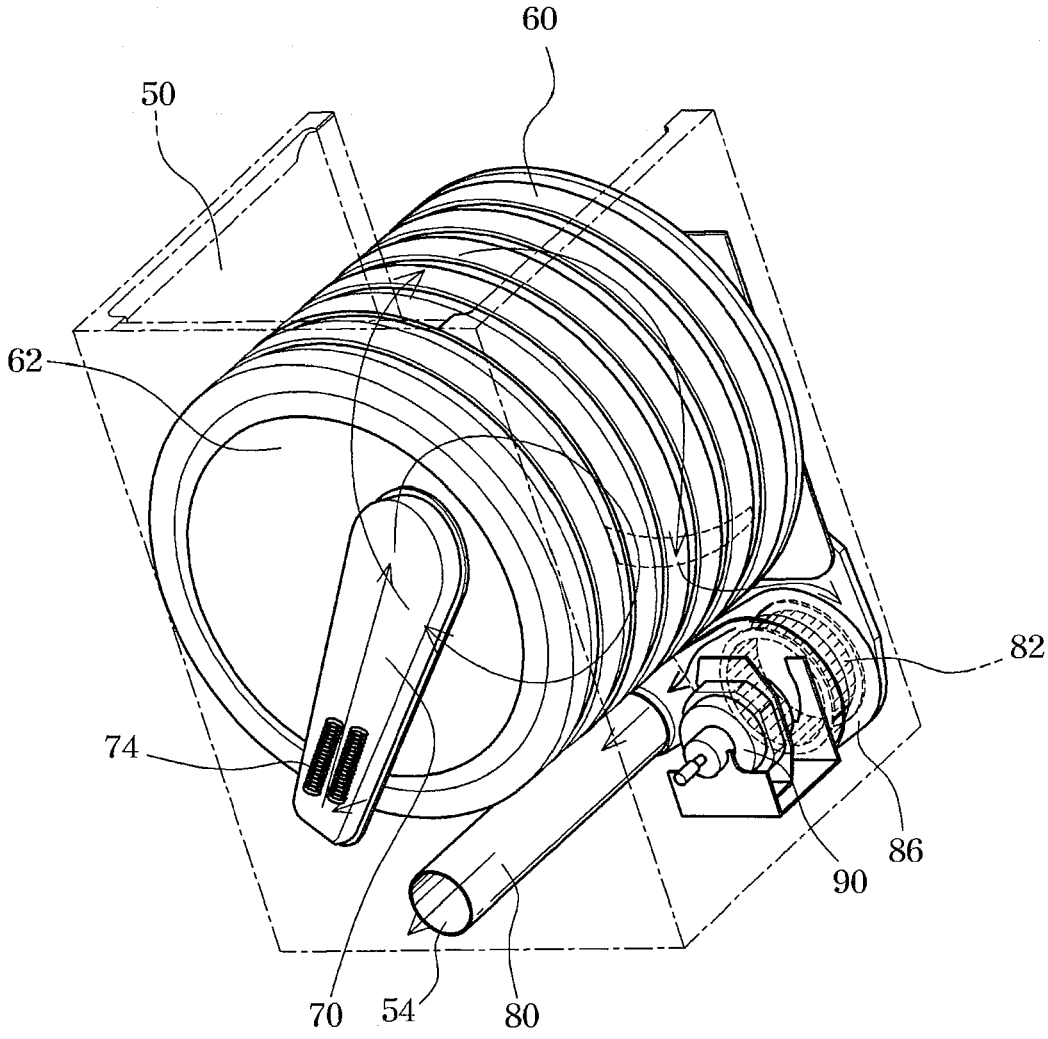
FIG. 3 is a rear perspective view of a dryer having a heater-integrated intake duct according to one embodiment of the present invention.
Figure 4:
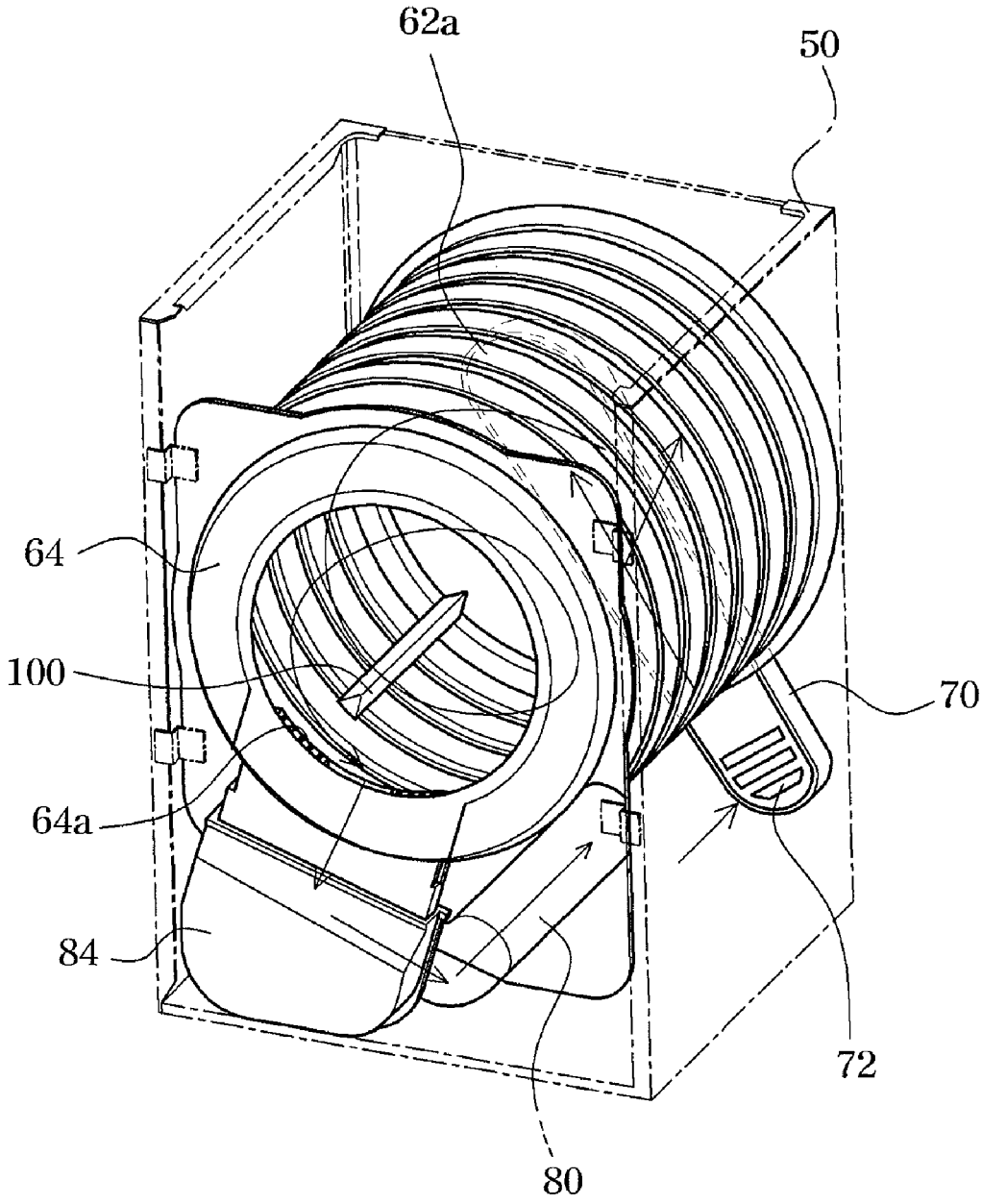
FIG. 4 is a front perspective view of the dryer according to the embodiment of the present invention.
Figure 5:
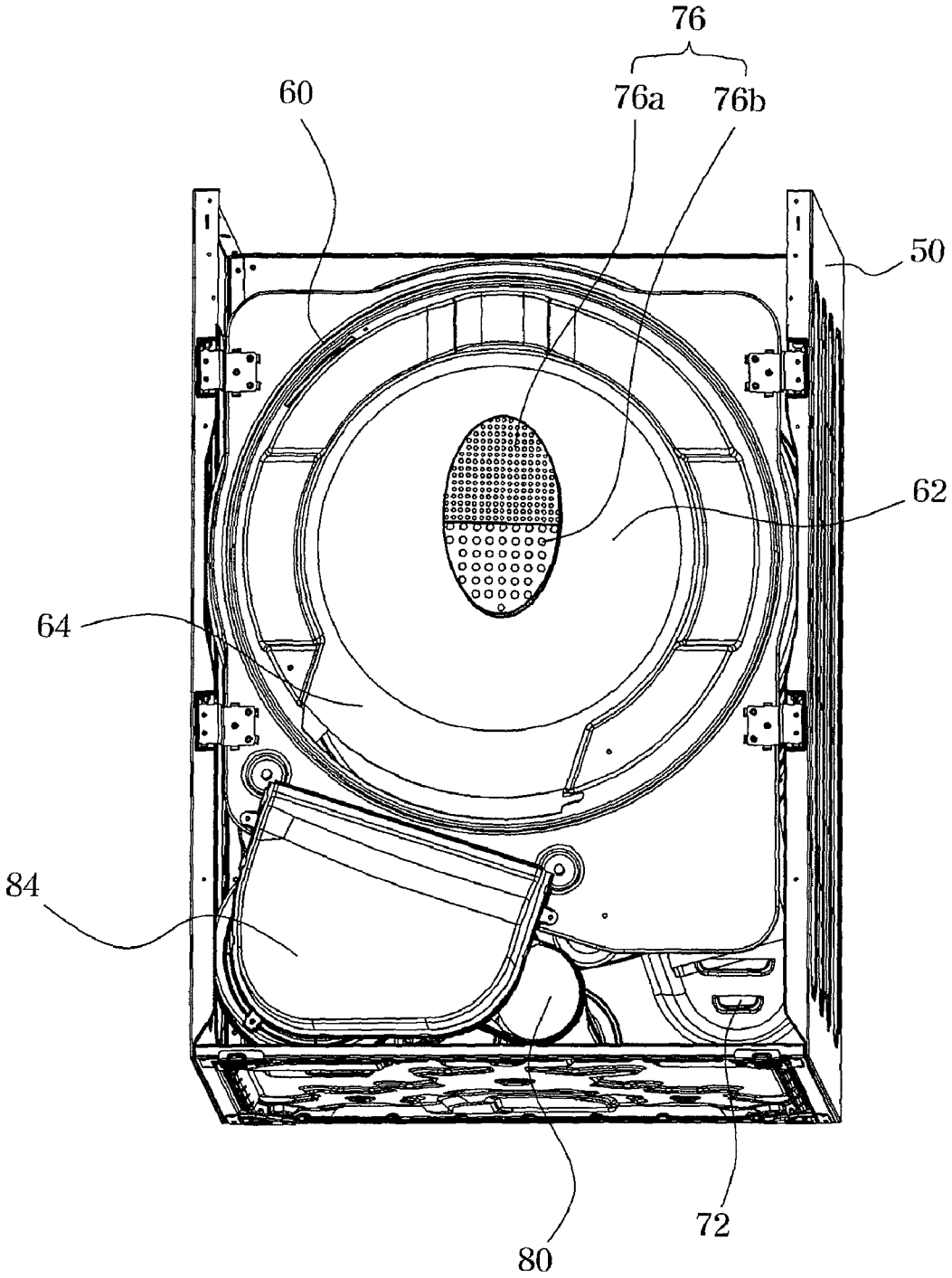
FIG. 5 is a front perspective view of the dryer according to the embodiment of the present invention, illustrating a support panel of the dryer.
Figure 6:
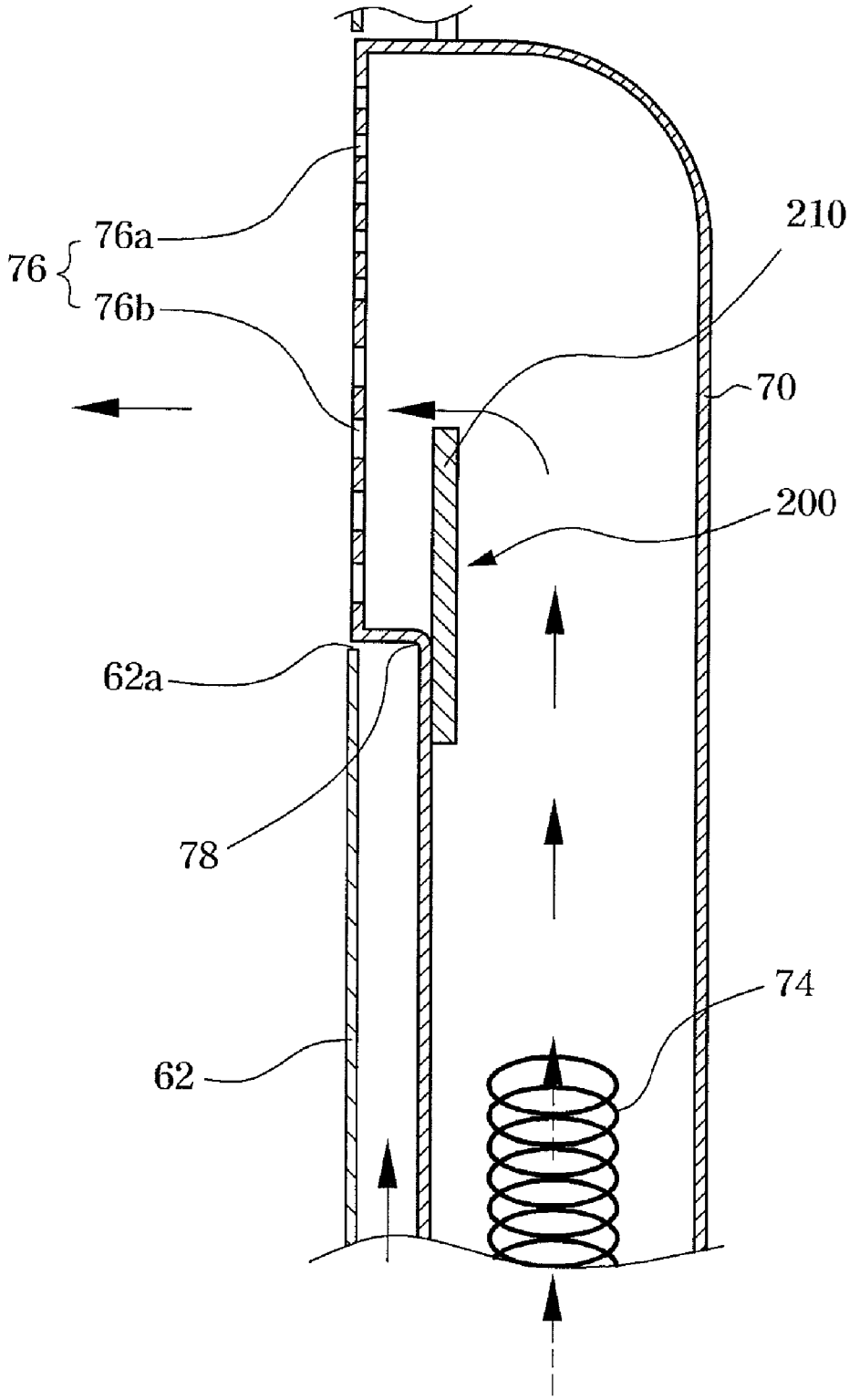
FIG. 6 is a sectional view of the intake duct of the dryer according to the embodiment of the present invention.

FIG. 3 is a rear perspective view of a dryer having a heater-integrated intake duct according to one embodiment of the present invention, FIG. 4 is a front perspective view of the dryer according to the embodiment of the present invention, FIG. 5 is a front perspective view of the dryer according to the embodiment of the present invention, illustrating a support panel of the dryer, and FIG. 6 is a sectional view of the intake duct of the dryer according to the embodiment of the present invention.

Referring to FIGS. 3 to 6, the dryer according to one embodiment of the present invention includes a cabinet 50 having an air vent 54, a drum 60 rotatably disposed inside the cabinet 50 to receive laundry, a support panel 62 supporting the drum 60 and having a through hole 62*a* formed therein, a plurality of lifters 100 formed on an inner surface of the drum 60 to lift and drop the laundry rotating inside the drum 60, an intake duct 70 disposed inside the cabinet 50 to guide air into the drum 60, a heater 74 disposed inside the intake duct 70, an exhaust fan 82 disposed between the drum 60 and the air vent 54, an exhaust duct 80 disposed between the exhaust fan 82 and the air vent 54, a drive motor 90 for driving the exhaust fan 82, and an extended part 200 configured to cause heated air to be supplied into the drum 60 after surmounting the extended part 200.

When power is applied to the drive motor 90, the exhaust fan 82 is rotated to circulate air. Then, air inside the cabinet 50 is heated by the heater 100 while passing through the heater 100, and is supplied into the drum 60 through the intake duct 70 to dry or sterilize laundry in the drum 60. Then, the air is discharged outside the cabinet 50 through the vent 54 via the exhaust duct 80 by the exhaust fan 82.

The drum 60 has a cylindrical shape and is opened at front and rear sides. The drum 60 is installed on the support panel 62 which has a through-hole 62*a* formed therein. The through-hole 62*a* is coupled to the intake duct 70. After being heated by the heater 74, air flows into the drum 60 through the intake duct 70. A front panel 64 is disposed between the front side of the drum 60 and an opening of the cabinet 50, and has a discharge port 64*a* formed at a lower side of the front panel 64. The discharge port 64*a* is connected with an extension tube 84 extending toward the ventilation fan 82. A housing 86 is disposed between the extension tube 84 and the exhaust duct 80 to accommodate the ventilation fan 82 such that the ventilation fan 82 can rotate inside the housing 86.

The intake duct 70 extends from a lower end of the cabinet 50 to a rear upper portion of the cabinet 50 corresponding to the through-hole 62*a*, and has a suction hole 72 formed at the lower end of the intake duct 70 and a supply hole 76 formed at the upper end thereof to be inserted into the through-hole 62*a*. With this configuration, air flowing from the interior of the cabinet 50 into the intake duct 70 through the suction hole 72 can be heated while passing through the heater 100. Then, the heated air moves to the upper side of the cabinet 50 along the intake duct 70 and flows into the drum 60 via the supply hole 76 and the through-hole 62*a*. The drum 60 connected to the drive motor 90 via a belt 96 is rotated while the laundry is dried or sterilized therein.

At least one side of the intake duct 70 protrudes towards the rear side of the cabinet 50, the suction hole 72 is in communication with the interior of the cabinet 50, and the supply hole 76 is inserted into the cabinet 50 to communicate with the through-hole 62*a*. Since the heater 74 is provided inside the intake duct 70 disposed on the outer surface of the cabinet 50, the distance between the heater 74 and the drum 60 becomes shorter than that of the conventional dryer in which the heater 74 is provided at the lower side of the cabinet 50. Therefore, the dryer according to this embodiment can prevent air heated to a predetermined temperature or more by the heater 74 from undergoing thermal loss while the air flows along the intake duct 70, so that operating efficiency of the dryer can be improved. Furthermore, the heater 74 is located at the outer side of the cabinet 50 that defines a different space from that of the drive motor 90, which is likely to overheat, so that the interior of the cabinet 50 can be prevented from overheating, thereby preventing malfunction or damage of the dryer caused by overheating of the drive motor 90.

The intake duct 70 includes a supply hole 76 communicating with the through-hole 62*a*, a suction hole 72 into which air is introduced, and a bent part 78 formed by bending an end of the intake duct 70, which is formed with the supply hole 76, toward the through-hole 62*a*. Since the end of the intake duct 70 is bent, the bent part 78 is inserted into the cabinet 50 to communicate with the through-hole 62*a* of the support panel 62 disposed inside the cabinet 50.

The supply hole 76 includes first holes 76*a* corresponding to an inner wall of the intake duct 70 and second holes 76*b* corresponding to the extended part 200. The first holes 76*a* are formed in a region corresponding to a region extending upward from a location where the extended part 200 terminates, and the second holes 76*b* are formed in a region corresponding to the extended part 200. In this embodiment, the second holes 76*b* are formed in the region corresponding to the extended part 200, and the first holes 76*a* are formed above the second holes 76*b*. Hence, air, which is heated while passing through the heater 74, is partially supplied into the drum 60 through the first holes 76*a* after flowing over the extended part 200, and is partially supplied into the drum 60 through the second holes 76*b* after bypassing the extended part 200. Therefore, the air supplied into the drum 60 through the second holes 76*b* adjacent to the heater 74 can be maintained at a lower temperature, thereby preventing overheating of the drum 60, which can be caused by a narrow distance between the supply hole 76 and the heater 74.

According to one embodiment, the number of second holes 76*b* may be less than the number of first holes 76*a* to increase the amount of air supplied through the first holes 76*a* distant from the heater 74 and to decrease the amount of air supplied through the second holes 76*b* adjacent to the heater 74. With this configuration, the amount of air reaching the first holes 76*a* after flowing over the extended part 200 increases, thereby effectively preventing overheating of the interior of the drum 60.

According to another embodiment, the sizes of the second holes 76*b* may be larger than those of the first holes 76*a* to allow air supplied through the second holes 76*b* to be easily discharged, preventing a vortex of air from being generated between the second holes 76*b* and the extended part 200.

The extended part 200 includes a partition 210 provided to the bent part 78. With this configuration, air having passed through the heater 74 is prevented from directly flowing toward the second holes 76*b*. Instead, the air flows towards the first holes 76*a* beyond the partition 210 and is finally supplied into the drum 60 through the first holes 76*a*. At this time, some of the air flowing towards the first holes 76*a* moves along the partition 210 and is supplied into the drum 60 through the second holes 76*b*. With this operation, the temperature of air supplied into the drum 60 is lowered by a predetermined degree, so that it is possible to prevent excessively overheated air from being supplied into the drum 60. In one embodiment of the invention, the extended part 200 extends from the bent part 78 in a flow direction of air.

Now, operation of the dryer including the heater-integrated intake duct according to one embodiment of the present invention will be described below.

Figure 7:
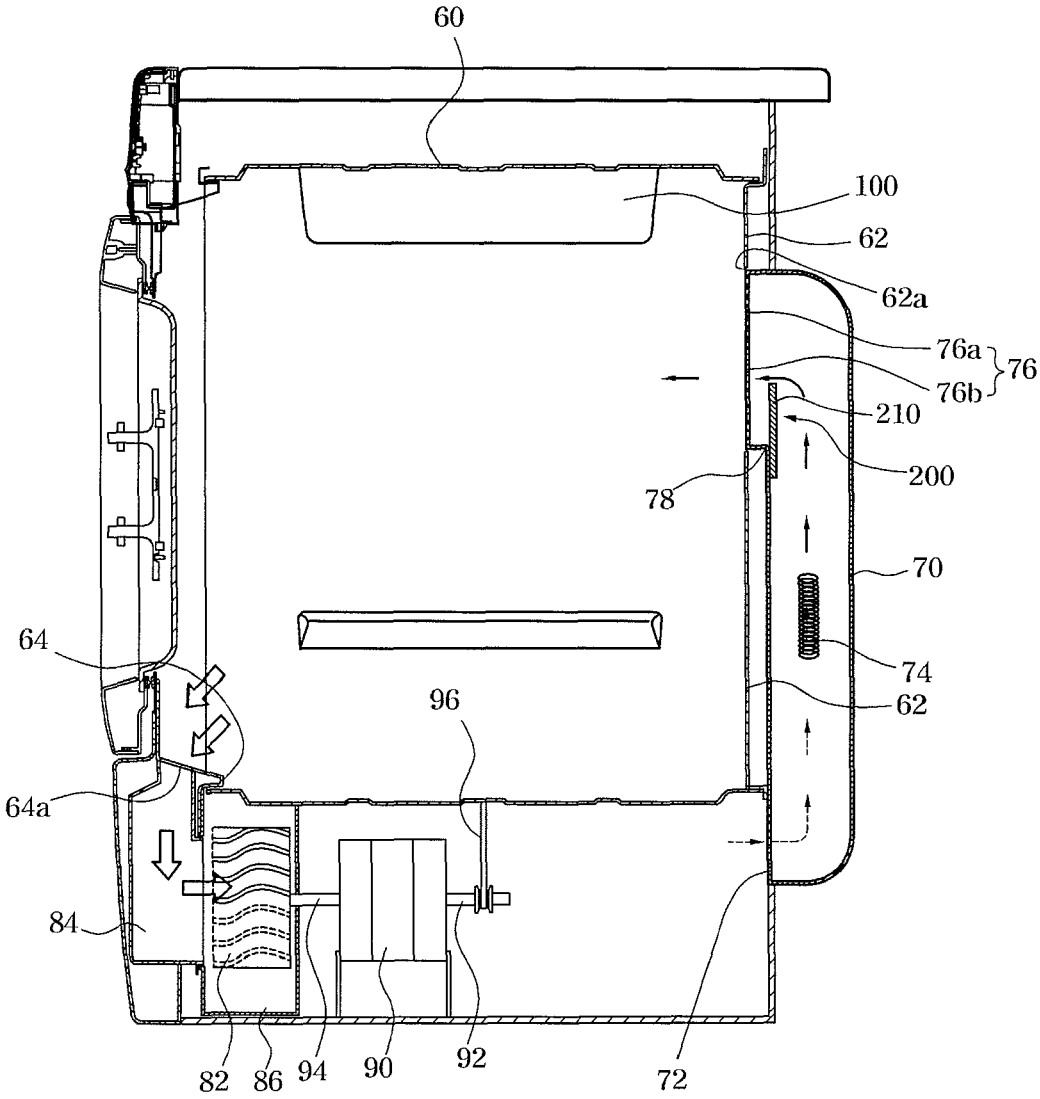
FIG. 7 is a side section view of an intake passage in the dryer according to the embodiment of the present invention.
Figure 8:
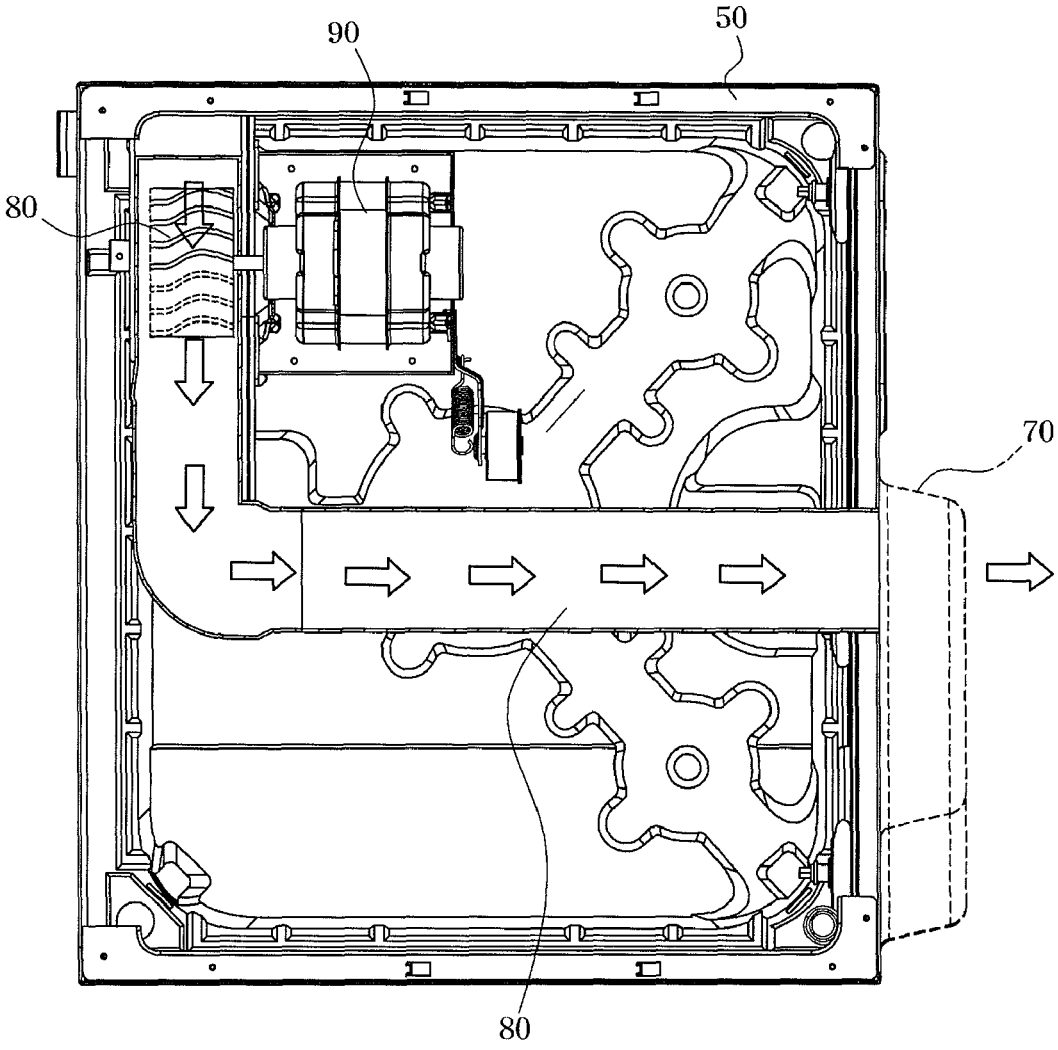
FIG. 8 is a plan view of an exhaust passage in the dryer according to the embodiment of the present invention.

FIG. 7 is a side section view of the dryer including an intake duct according to one embodiment of the present invention, and FIG. 8 is a plan view of an exhaust passage of the dryer according to the embodiment of the present invention.

Referring to FIGS. 4 and 6 to 8, when power is applied to the drive motor 90 and the heater 74 to drive the ventilation fan 82 and the drum 60, air inside the cabinet 50 is introduced into the drum 60 through the intake duct 70. While flowing into the drum 60, the air flows toward the upper side of the cabinet 50 through the intake duct 70 which extends in the vertical direction on the rear side of the cabinet 50, and is heated by the heater 100. Then, heated air is supplied into the drum 60 through the supply hole 76 and the through-hole 62*a* to dry or sterilize laundry accommodated in the drum 60.

At this time, the heated air having passed through the heater 74 flows over the extended part 200 towards the first holes 76*a* and is then supplied into the drum 60 through the first holes 76*a*. Further, some of the air flowing towards the first holes 76*a* moves along the partition 210 and is supplied into the drum 60 through the second holes 76*b*. As such, since a flow path of air is extended by the extended part 200, the temperature of heated air is lowered by a predetermined temperature during passage of the air. Here, since the temperature of air supplied into the drum 60 through the second holes 76*b* adjacent to the heater 74 is maintained at a lower temperature, it is possible to prevent excessively overheated air from being supplied into the drum 60. By this operation, the excessively heated air can be prevented from being supplied into the drum 60, thereby preventing damage of laundry or components of the dryer.

When introduced into the drum 60 via the through-hole 62*a*, the heated air dries the laundry as a vortex to perform the drying operation inside the drum. After the drying operation, the air is discharged outside the drum 60 through the discharge port 64*a*. Then, the discharged air flows into the housing 86 of the ventilation fan 82 through the extension tube 84 communicating with the discharge port 64*a* and is exhausted from the cabinet 50 through the air vent 54 via the exhaust duct 80.

As apparent from the above description, in the dryer according to the present invention, an intake duct having a heater disposed therein is located on an outer lateral side of a cabinet that defines a different space from that for a drive motor, thereby preventing the dryer from excessively overheating.

In addition, according to the present invention, the dryer includes an extended part which extends a flow passage of air having passed through the heater, so that the temperature of air supplied into a drum can be lowered. Thus, the present invention can prevent laundry from being damaged due to overheating of air supplied into the drum, and can also prevent malfunction and damage of the dryer caused by overheating of the interior of the drum.

Although the present invention has been described with reference to the embodiments and the accompanying drawings, these are given by way of illustration only, and, it will be apparent to those skilled in the art that various modifications and other equivalent embodiments can be made without departing from the scope of the present invention. In addition, although the present invention has been described with reference to the dryer having the heater-integrated intake duct as specifically disclosed herein, it should be noted that the dryer has been illustrated as an example, and that the heater-integrated intake duct of the present invention may be applied to other products without being limited to the heater-integrated intake duct for the dryer. Therefore, the scope and spirit of the invention is limited only by the claims set forth herein as follows.

What is claimed is:

1. A dryer having a heater-integrated intake duct, comprising:

a support panel having a through-hole;

an intake duct disposed on a first surface of the support panel;

a drum into which air flows via the through-hole, the drum supported on a second surface of the support panel, the second surface being opposed to the first surface;

a heater disposed inside the intake duct to heat the air flowing into the drum; and an extended part provided on the intake duct and configured to cause the heated air to be supplied into the drum after surmounting the extended part, wherein the intake duct includes a suction hole into which the air is introduced, a supply hole formed on an end of the intake duct and communicating with the through-hole, and a bent part formed by bending said end of the intake duct toward the through-hole, the extended part comprises a partition, the partition provided on the bent part so as to protrude into the intake duct, the supply hole includes first holes formed in a first region which does not overlap the extended part as viewed facing the first surface, and second holes formed in a second region that overlaps the extended part as viewed facing the first surface, the size of the second holes being different from the size of the first holes, and the intake duct defines a space between the second holes and a surface of the extended part.

2. The dryer according to claim 1, wherein the number of the second holes is less than the number of the first holes.

3. The dryer according to claim 1, wherein the second holes have larger sizes than those of the first holes.

4. The dryer according to claim 1, wherein the extended part extends from the bent part in a flow direction of air.

5. The dryer according to claim 1, wherein one side of the intake duct is disposed outside the cabinet.

6. The dryer according to claim 5, wherein the one side of the intake duct is disposed on a lateral side of the cabinet.

7. The dryer according to claim 1, wherein the heater is disposed on a lateral side of the cabinet.

8. The dryer according to claim 7, further comprising:

a drive motor provided at a lower side of the cabinet.

* * * * *